United States Patent [19]

Gigliotti, Jr. et al.

[11] Patent Number: 4,906,436

[45] Date of Patent: Mar. 6, 1990

[54] HIGH STRENGTH OXIDATION RESISTANT ALPHA TITANIUM ALLOY

[75] Inventors: Francis X. Gigliotti, Jr., Scotia; Raymond G. Rowe, Schenectady, both of N.Y.; Gerald E. Wasielewski, deceased, late of Cincinnati, Ohio, Margaret M. Wasielewski, executrix

[73] Assignee: General Electric Company, Schenectady, N.Y.

[21] Appl. No.: 213,573

[22] Filed: Jun. 27, 1988

[51] Int. Cl.[4] ..... C22C 14/00; C22C 15/00

[52] U.S. Cl. ..... 420/418; 148/407; 148/421; 420/417; 420/419

[58] Field of Search ..... 420/417, 418, 419; 148/407, 421

[56] References Cited

U.S. PATENT DOCUMENTS

| | | | |
|---|---|---|---|
| 3,622,406 | 11/1971 | Vordahl | 148/407 |
| 3,666,453 | 5/1972 | Goosey | 420/419 |
| 4,060,430 | 11/1977 | Kavesh | 148/421 |
| 4,606,886 | 8/1986 | Neal | 420/419 |

FOREIGN PATENT DOCUMENTS

| | | | |
|---|---|---|---|
| 0893210 | 4/1962 | United Kingdom | 420/419 |

OTHER PUBLICATIONS

Seagle, SR/Hall, GS/Bomberger, HB, "High Temperature Properties of Ti-6A1-2Sn-4Zr-2Mo-0.09Si", Metals Engineering Quarterly (Feb. 1975), pp. 48-54.

Imgram, AG/Williams, DN/Ogden, HR, "Tensile Properties of Binary Ti-Zr and Ti-Hf Alloys", Journal of the Less-Common Metals, 4 (1962), pp. 217-225.

Crossley, FA/Carew, WF, "Embrittlement of Ti-Al Alloys in the 6 to 10 Pct Al Range", Transactions AIME, Journal of Metals, 43 (Jan. 1967), pp. 43-46.

Inoue, A/Kimura, H/Sakal, S/Masumoto, T, "Mechanical Properties of Titanium-Based Amorphous Alloys with Metalloids", The Research Institute for Iron, Steel and Other Metals, Tohoku Univ., Sendai, Japan, pp. 1137-1145.

Imgram, AG/Williams, DN/Ogden, HR, "Effect of Zirconium and Hafnium Ternary Additions on the Tensile and Creep Properties of Titanium-Aluminum Alloys" Transactions of the ASM, vol. 55 (1962), pp. 202-213.

Donachie, Jr., MJ, Editor, "Titanium and Titanium Alloys", Source Book, American Society for Metals, pp. (title page)+3-19, 23-32.

"IMI Titanium 829", IMI Titanium Limited (Aug. 28, 1980) pages (title page)+1-6+6 pages of Figures/-Plates+Back Sheet.

Sasano, H and Kimura, H., "Solid-Solution Strengthening of Alpha Titanium Alloys", Nat'l. Research Inst. for Metals, Japan, pp. 1147-1154.

Sastry, SML/Peng, TC/Meschter, PJ/O'Neal, JE, "Rapid Solidification Processing of Titanium Alloys", J. of Metals (Sep. 1983) pp. 21-28.

Froes et al., Jour. Metals, Aug. 1987, p. 14.

*Primary Examiner*—Upendra Roy

*Attorney, Agent, or Firm*—Paul E. Rochford; James Davis,Jr.; James Magee, Jr.

[57] ABSTRACT

Alpha titanium alloys containing aluminum, hafnium and/or tantalum has been found to have improved creep and tensile strengths as well as oxidation resistance at temperature up to about 700° C. without embrittlement.

6 Claims, 4 Drawing Sheets

CREEP RESISTANCE AT 650°C. AND 20 ksi

TENSILE STRENGTH

OXIDATION OF ALLOY EXAMPLE 12

OXIDATION OF ALLOY EXAMPLE 13

HIGH STRENGTH OXIDATION RESISTANT ALPHA TITANIUM ALLOY

The present invention relates to alloys of titanium and particularly to alpha titanium alloys which display high strength as well as oxidation resistance. More specifically, it relates to titanium base alloys containing aluminum, tantalum or hafnium and possessing high creep and tensile strength properties coupled with good resistance to oxidation at elevated temperatures.

BACKGROUND OF THE INVENTION

It is well known that titanium metal has relatively high strength at high temperatures and a relatively low density. The combination of strength at high temperature and low density makes titanium base alloys attractive for use in applications including aircraft engines where high temperature environments may be encountered either intermittently or continuously. The temperature of use applications sought for advanced titanium base alloys is about 700° C. A titanium base alloy capable of operating at 700° C. would find wide use in aircraft engines where it could replace more dense nickel base alloys in various structural applications. However, the achievement of high strength at high temperatures has been limited by the inability to find strengthening additives for titanium above a given level without causing embrittlement of the base metal. When strengthening additives such as aluminum or tin are made above a modest level to the hexagonal titanium the result has been the reduction in ductility and an effective embrittlement of the metal. Also, it is known that alloy additions which would be made to ductilize a titanium alloy by producing a small amount of the cubic beta phase in the alloy result in the reduction of the elevated temperature strength. Accordingly, what has been sought in this technology is the ability to add alloying elements which add significant strength to the hexagonal alpha titanium base alloy without causing an embrittlement of the alloy.

PRIOR ART

Typical current titanium base alloys include such alloys as Ti6242S the composition of which in weight percent is 6% aluminum, 2% tin, 4% zirconium, 2% molybdenum and about 0.1% silicon with the balance being titanium. Another current titanium base alloy is Ti5331S. This alloy is also known as IMI829. The composition of this alloy in weight % is 5.5% aluminum, 3.5% tin, 3% zirconium, 1% columbium, 0.25% molybdenum, 0.3% silicon and the balance titanium. These alloys have been developed from the recognition that the optimum alloys for high temperature use would have a majority phase of alpha, close packed hexagonal, titanium containing aluminum in solid solution. The Ti6242S alloy is described by S. R. Seagle, G. S. Hall, and H. B. Bomberger in "High Temperature Properties of Ti-6Al-2Sn-4Zr-2Mo-0.09Si" in Metal Engineering Quarterly, Feb. 1975, pp. 48–54. The Ti6242S composition lies outside the scope of our invention in that the elements found critical to our invention, and specifically tantalum and hafnium, are absent from the 6242 alloy.

The Ti5331S alloy is described in a monograph entitled "IMI Titanium 829" published by IMI Titanium Limited, Birmingham, England, 28, Aug. 1980. The Ti5331S composition lies outside the scope of our invention inasmuch as it lacks the elements which are critical to the present invention and namely tantalum and hafnium.

The degree of strengthening of alpha titanium is limited by the onset of the precipitation of an ordered hexagonal phase, called alpha 2, based on a composition corresponding to $Ti_3(Al, Sn)$. The onset of the precipitation of alpha 2 leads to brittle behavior as is shown by F. A. Crossley and W. F. Carew in "Embrittlement of Ti-Al Alloys in the 6 to 10 Pct Al Range", in the Journal of Metals of Jan. 1957 at pages 43–46. Crossley and Carew show that this embrittlement exists at the 8 weight percent level of aluminum addition. As a consequence of this embrittlement, there is a limiting of the amount of stregthening which can be achieved by aluminum additions. Investigators have looked for other additions which would work in concert with aluminum to avoid the embrittlement and have also tried to quantify the effect of other elements on the embrittling behavior.

The effect of zirconium and hafnium additions to titanium and to titanium aluminum alloys was studied by A. G. Imgram and his co-workers. Zirconium and hafnium form continuous solid solutions with titanium. Both zirconium and hafnium were shown by these researchers to improve the tensile behavior to about the same degree. This is reported in an article by A. G. Ingram, D. N. Williams, and G. R. Ogden in "Tensile Properties of Binary Titanium-Zirconium and Titanium-Hafnium Alloys", in the Journal of the Less Common Metals, Volume 4, 1962, at pages 217–225. In the work on these binary alloys it was noted that the additions of zirconium to the binary titanium zirconium alloy was up to about the 10 atomic percent and that the additions of hafnium to the binary titanium hafnium alloys was up to about the 10 atomic percent level. The addition of hafnium above the 10 atomic percent level results in the precipitation of omega phase which is an embrittling metastable phase and this precipitation results in a reduction in the ductility of the binary titanium-hafnium alloys although these binary alloys have higher strength at hafnium concentrations above the 10 atomic percent level. In the Applicant's examples which follow the concentration of hafnium which is employed in the alloys of this invention is much less than 10 atomic percent.

The effect of zirconium additions and of hafnium additions on the properties of titanium-aluminum base alloys were reported by A. G. Imgram, D. N. Williams and H. R. Ogden in an article entitled "Effect of Zirconium and Hafnium Ternary Additions on the Tensile and Creep Properties of Titanium-Aluminum Alloys" in the Transactions of ASM, Volume 55, 1962, at pages 202–213. In these studies, a report is made of the addition of 5 weight percent hafnium or alternatively of zirconium to binary zirconium aluminum alloys containing respectively 6.5 weight percent aluminum and 8 weight percent aluminum. Studies were made of the creep and tensile properties of the resultant alloys and a conclusion as stated on page 210 of the article is as follows:

> "The beneficial effect of hafnium additions on Ti-Al alloys was somewhat less than that of zirconium."

In the description of our invention which follows our findings are precisely the reverse or opposite of the findings reported in this ASM article.

A beneficial effect of hafnium in the presence of silicon was described by Goosey in U.S. Pat. No. 3,666,453. Goosey showed that hafnium in the presence of silicon improves creep resistance and stability. However, he found no improvement in strength when hafnium was added to alloys containing no silicon. U.S. Pat. No 3,666,543 states:

"When hafnium is added to alloys lacking silicon, such as titanium, 5% aluminum, 3% tin and 2% zirconium or titanium, 3% aluminum, 6% tin and 2% zirconium, there is little improvement in tensile properties with hafnium contents up to 5% . . . " and "The addition of hafnium does not improve the creep strength of such alloys at 540° C. which is inferior to that of known alloys."

In contrast, the alloys of our invention exhibit markedly improved creep resistance due to hafnium additions independent of silicon content. The alloys of U.S. Pat. No. 3,666,453 are limited to those having an aluminum equivalent in weight percent of 4.5 to 6.5, where aluminum equivalent is defined as the sum of the weight percent aluminum plus one third the weight percent tin. This weight percent aluminum equivalent uses a factor of one third for tin replacement because the atomic weight of tin is about 2.5 times that of aluminum. On an atomic percent basis, U.S. Pat. No. 3,666,453 is limited to alloys where the atomic percent aluminum plus tin is 7.7 to 11. Based on our discoveries, this is less than the amount required to show the unexpected beneficial effects hafnium exhibits independent of silicon content.

The effect of binary alloying additions to titanium on the strength of the resultant alloy at room temperature and at 600° C. was reported by Hisaoki Sasano and Hirozo Kimura in an article entitled "Solid-Solution Strengthening of Alpha Titanium Alloys" in Titanium 80: Science and Technology, H. Kimura and O. Izumi, editors, The Metallurgical Society of AIME, 1980, at pages 1147–1154. In this work, Sasano and Kimura evaluated the binary alloys of titanium with each of the elements zirconium, hafnium, aluminum, indium, tin, columbium, tantalum, vanadium and silver. In FIG. 4 of this reference, evidence is presented which shows that neither hafnium nor tantalum yield high strengthening rates in titanium in the experiments conducted by Sasano and Kimura.

A summary of commercial and semicommercial grades of titanium alloys is presented by Matthew Donachie, Jr. in the "Introduction to Titanium and Titanium Alloys" section of a book by Matthew J. Donachie, Jr. entitled "Titanium and Titanium Alloys Source Book". The book is edited by Matthew J. Donachie, Jr. and published by the American Society for Metals in 1982 and the referenced section appears at pages 3–19. In this section no compositions are noted which contain hafnium. One composition is listed in Table 3 of this section which contains tantalum and this is specifically an alloy designated as Ti6211. The composition of this alloy in weight percent is 6% Al, 2% Cb, 1.0% Ta, 0.8% Mo and the balance titanium. From the studies which we have made and which are described below it is our conclusion that the aluminum and tin content of the Ti6211 alloy is below the level which is necessary for good high temperature creep resistance. Also from our studies we conclude that the columbium level of the alloy Ti6211 is in excess of the amount which is permitted for good high temperature properties.

The Ti6211 alloy is further described by S. R. Seagle and L. J. Bartlo in the section entitle "Physical Metallurgy and Metallography of Titanium Alloys". This section also appears in the book entitled Titanium and Titanium Alloys Source Book which is edited by Matthew J. Donachie, Jr. as editor and published by the American Society for Metals in 1982 and particularly at pages 23–32. On page 24 of this section, Ti6211 is described as being designed with a low aluminum content to prevent aqueous stress corrosion. The statement appears at page 24 that:

"With this knowledge, alloys such as Ti-6Al-2Cb-1Ta-1Mo have been developed recently for application in marine environments."

The incorporation of rare earth metal or yttrium compound dispersoids is described by S. M. L. Sastry, T. C. Peng, P. J. Meschter, and J. E. O'Neal in an article entitled "Rapid Solidification Processing of Titanium Alloys" in the Journal of Metals published in Sept. 1983 at pages 21–27. While rare earth and yttrium additions are described, the benefits of tantalum or hafnium are not recognized. Further, Sastry et al. on page 26 specifically proscribe processing above about 850° C. in order to avoid coarsening of the dispersoid. They say in part that:

". . . for example, to produce the required size and distribution of dispersoids in Ti-RE alloys, consolidation must be performed below ~ 850° C. to avoid excess dispersoid coarsening."

By contrast, the alloys of our invention which are described below are all given a solution treatment above the beta transus and thus above about 1000° C.

BRIEF SUMMARY OF THE INVENTION

It is accordingly one object of the present invention to provide alloys which can be used effectively at temperatures up to and including 700° C.

Another object is to provide such alloys which have acceptable ductility at room temperature.

Another object is to provide such alloys which have good environmental resistance.

Other objects will be in part apparent and in part pointed out in the description which follows.

In one of its broader aspects the objects of the invention may be achieved by providing a titanium base alloy composition in which the majority matrix phase is the close packed hexagonal phase of titanium and in which this phase is strengthened by solid solution elements aluminum, tin, hafnium and tantalum.

In another of its broader aspects the objects can be achieved by incorporating rare earth compound dispersoids in the titanium base alloy to improve ductility by dispersing slip or nucleating many fine voids and thus permitting the incorporation of higher levels of aluminum and tin for a given level of ductility.

In general the alloys of the present invention are useful alloys when prepared directly as a melt which is then solidified. The alloys do have some superior properties when the preparation includes a rapid solidification step.

Where the rare earth content exceeds 0.1 atom % the inclusion of a rapid solidification step is preferred. The use of rapid solidification tends to maximize solubility limits of the ingredients; it tends to minimize alloy segregation; and it tends to produce dispersoids.

BRIEF DESCRIPTION OF THE DRAWINGS

The invention and the description of the invention which follows will be understood with greater clarity by reference to the accompanying drawings in which.

DETAILED DESCRIPTION OF THE INVENTION

Figure 1:
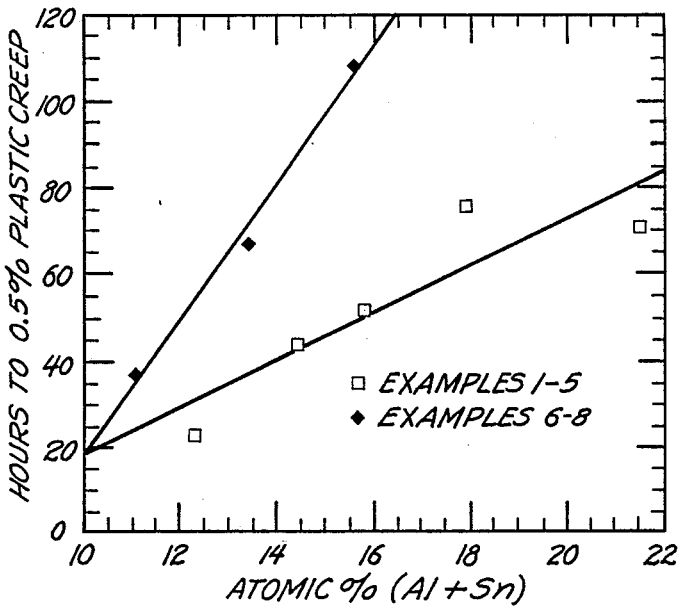
FIG. 1 is a graph of the creep resistance of alloys as provided pursuant to the present invention at 650° C. and 20 ksi.

We have observed that titanium base alloys with a matrix phase with hexagonal crystal structure (also known as alpha phase matrix) have lower diffusion coefficients and higher moduli of elasticity than titanium base alloys with the cubic crystalline phase (also known as beta titanium matrix). We have also observed that the lower diffusion coefficient results in an intrinsicly higher creep resistance and a better microstructural stability. Further, we have observed that the higher modulus imparts intrinsicly higher strengthening rates to the titanium base alloy from a number of the various available strengthening mechanisms.

We have discovered that the additions of tantalum and hafnium in quantities as explained hereafter results in the solid solution strengthening of the alpha phase.

It is known that there are only a few elements which have high solubility in alpha matrix titanium. These elements include aluminum, tin, gallium, oxygen and nitrogen. We have discovered further that limited amounts and typically less than about 3 atomic percent of another group of elements can be added to the alpha matrix titanium without resulting in the production of the beta phase titanium. These elements are columbium (niobium), tantalum, vanadium, tungsten and molybdenum.

We were well aware that the materials of choice for additions to titanium to achieve high temperature creep resistance are zirconium and columbium. We have discovered, however, that the additions of hafnium and tantalum in place of zirconium and columbium result in the production of alloys with higher temperature creep resistance than the conventional zirconium and columbium containing alloys. We are not aware of the reason why this happens but we have discovered that the titanium base alloy is improved by the additions of the combination of hafnium and tantalum rather than by the conventional addition of zirconium and columbium.

We have further discovered that optionally an yttrium or rare earth metal oxide may be added as a dispersion to an alpha titanium matrix base to influence the tensile fracture of the titanium base metal at low temperatures. The presence of fine oxide particles is believed to produce fracture by nucleating voids around the particles. The failure is believed to occur when the voids nucleating around the particles link up. We have found that the resultant ductility of the alpha matrix titanium with the optional dispersion is more ductile than a matrix in which fracture is caused by a persistent slip in a localized band.

The alloys which are employed as a basis for comparison in the development of alloys described in this application are the two commercially available and currently used alloys Ti6242S and Ti5331S which are discussed above in the prior art section. Their compositions are described herein in terms of atomic percent since the substitutions of one atomic specie for another is not accomplished by equal weight substitutions and also because the onset of development of intermediate phases is easier to view from an atomic point of view. The compositions of these state-of-the-art alloys in atomic percent are listed in Table 1 immediately below.

TABLE 1

| | Compositions of current alloys, atomic % | | | | | | | | |
|---|---|---|---|---|---|---|---|---|---|
| Alloy | Ti | Al | Zr | Hf | Sn | Cb | Ta | Mo | Other |
| Ti6242S | 85.4 | 10.6 | 2.1 | — | 2.0 | — | — | 1.0 | 0.2 Si |
| Ti5331S | 86.1 | 9.7 | 1.6 | — | 1.4 | 0.5 | — | 0.1 | 0.5 Si |

EXAMPLE A and B

These alloys Ti6242S and Ti5331S are representative of the most advanced high temperature titanium alloys which are commercially available at the present time. Both alloys contain the aluminum and tin additives which are deemed to be present for the purpose of stabilizing the hexagonal alpha phase. These conventional alloys also contain zirconium for additional solid solution strengthening; silicon for strain aging; and the refractory metals molybdenum and columbium to provide solid solution strengthening and stabilization of a small amount of cubic beta phase which may be present. The Ti6242S alloy contains approximately 1 atomic percent molybdenum and this alloy contains more beta phase than the Ti5331S alloy with 0.5 atomic percent columbium and 0.1 atomic percent molybdenum.

EXAMPLES 1-10

Ten experimental alloy compositions as listed in Table 2 were prepared.

TABLE 2

| | Compositions of experimental alloys in atomic % as produced by rapid solidification melt extraction | | | | | | | | |
|---|---|---|---|---|---|---|---|---|---|
| Alloy | Ti | Al | Zr | Hf | Sn | Cb | Ta | Mo | Other |
| 1 | 85.7 | 11.1 | 1.3 | — | 1.2 | 0.5 | — | 0.1 | 0.4 Er |
| 2 | 83.6 | 13.3 | 1.3 | — | 1.1 | 0.5 | — | 0.1 | 0.5 Tb |
| 3 | 81.7 | 14.7 | 1.3 | — | 1.1 | 0.5 | — | 0.1 | 0.6 Er |
| 4 | 80.2 | 16.9 | 1.3 | — | 1.0 | 0.5 | — | 0.1 | 0.3 Er |
| 5 | 76.8 | 20.4 | 1.3 | — | 1.1 | 0.5 | — | 0.1 | 0.3 Er |
| 6 | 83.1 | 9.9 | — | 1.5 | 1.2 | — | 1.0 | — | 0.3 Er |
| 7 | 83.1 | 12.1 | — | 1.5 | 1.3 | — | 1.0 | — | 0.3 Er 0.3 Si |
| 8 | 81.7 | 14.5 | — | 1.5 | 1.1 | — | 1.0 | — | 0.5 Y |
| 9 | 84.7 | 10.3 | 1.6 | 0.7 | 1.3 | 0.5 | — | 0.2 | 0.6 Er 0.5 Si |

TABLE 2-continued

| Compositions of experimental alloys in atomic % as produced by rapid solidification melt extraction | | | | | | | | | |
|---|---|---|---|---|---|---|---|---|---|
| Alloy | Ti | Al | Zr | Hf | Sn | Cb | Ta | Mo | Other |
| 10 | 82.8 | 12.7 | 0.7 | 0.7 | 1.1 | 0.7 | 0.7 | 0.1 | 0.2 Er 0.35 Si |

These alloys 1–10 above were prepared by rapid solidification melt extraction. Following the melt extraction the collected sample was consolidated at 840° C. and 30 ksi for 3 hours by a HIPping process. Following the HIPping the samples were extruded in an 8:1 ratio at 840° C. Following the extrusion the samples were solution heat treated for 2 hours above the beta transus. Following the beta solution treatment the samples were aged at temperatures between 600° C. and 750° C.

With reference now particularly to Table 2 the alloys listed in the Table are generally of two types. The alloys of Examples 1–5 inclusive are similar to the Ti5331S alloy but were made with a rare earth metal addition to produce an oxide dispersion. These alloys contain zirconium and columbium to provide a solid solution strengthening. The alloys of the Examples 1–5 are a series of alloys of the conventional type similar to the Ti5331S but the series of alloys 1–5 have increasing levels of the combination of aluminum and tin also expressed as the sum (Al+Sn).

By contrast the alloys of Example 6–10 are alloys representative of the compositions of this invention. The alloys 6–8 are free of zirconium and columbium but do contain hafnium and tantalum. The contained hafnium and tantalum are deemed to provide solid solution strengthening beyond such strengthening which is provided by the aluminum and tin content.

The alloys 9 and 10 contain tantalum and/or hafnium for strengthening but also contain the conventional strengthening elements zirconium and columbium at a level which is reduced relative to that of the conventional alloys which contain these zirconium and columbium elements. In both groups of alloys, that is in the group 1–5 and secondly in the group 6–10, the alloys are listed in an order of increasing levels of combined aluminum and tin. The alloys were prepared as described above.

The prepared alloys were tested for their creep properties at a temperature of 650° C. and at stress of 20 ksi. Each creep test specimen had a gauge diameter of 0.2 cm (0.08 inches).

To provide a basis for comparison conventional alloys Ti6242S and Ti5331S were prepared in a conventional manner as Examples A and B and were tested in the manner described above. The results of the creep tests are listed in Table 3.

TABLE 3

| Creep Resistance of Ti Alloys at 650° C. and 20 ksi | | | |
|---|---|---|---|
| Ex. | Alloy | atomic % (Al + Sn) | Time to 0.5% Creep |
| A | Ti6242S | 12.6 | 4.7 |
| B | IMI829 | 11.1 | 6.3, 8.2 (2 tests) |
| 1 | Alloy 1 | 12.3 | 22.8 |
| 2 | Alloy 2 | 14.4 | 43.9 |
| 3 | Alloy 3 | 15.8 | 51.7 |
| 4 | Alloy 4 | 17.9 | 76. |
| 5 | Alloy 5 | 21.5 | 71. |
| 6 | Alloy 6 | 11.1 | 37.0 |
| 7 | Alloy 7 | 13.4 | 67.1 |
| 8 | Alloy 8 | 15.6 | 108.3 |
| 9 | Alloy 9 | 11.6 | 53.7 |

TABLE 3-continued

| Creep Resistance of Ti Alloys at 650° C. and 20 ksi | | | |
|---|---|---|---|
| Ex. | Alloy | atomic % (Al + Sn) | Time to 0.5% Creep |
| 10 | Alloy 10 | 13.8 | 27 |

The test results which are listed in Table 3 are also plotted in FIG. 1. In FIG. 1 the atomic percent of the sum of aluminum plus tin is plotted as abscissa against the time to 0.5% creep as ordinate. As is evident from the legend of the figure, the plot of the creep properties of the compositions of the Examples 1–5 is plotted with squares and forms a low slope line and the creep properties of the compositions of the Examples 6–8 is plotted with the solid diamonds and is aligned along the upper and higher slope line of the FIG. The data as plotted in FIG. 1 dramatically demonstrates the remarkable increase in the creep resistance of the materials of the Examples 6–8 over that of the Examples 1–5. It is important to understand that the plot of FIG. 1 is actually a plot of the combined percentage of aluminum and tin against the creep resistance. Accordingly, what was found was that the alloys of Examples 6, 7 and 8 which use hafnium and tantalum for their solid solution strengthening are remarkably more creep resistant than the current alloys which employ the combination of columbium, molybdenum and zirconium. In other words for any given level of the sum of aluminum and tin, the creep resistance of the composition containing that level of aluminum and tin is greater in the alloys which contain the combination of hafnium and tantalum than it is in the alloys which contain the combination of columbium and zirconium. This change in the creep property of the hafnium and tantalum containing alloys is extremely important since the alloys do depend on the strengthening effect of aluminum and tin but in the case of the conventional alloys containing columbium and zirconium the amount of aluminum and tin which can be added to the alloy is limited because the higher concentrations of aluminum and tin cause an embrittlement due to the precipitation of the ordered hexagonal phase $Ti_3(Al, Sn)$ which is also known as the alpha-2 phase.

In other words for a given level of combination of aluminum and tin, an alloy which contains this level will be found to have an improved creep resistance if the alloy also contains the combination of hafnium and tantalum as strengthening elements rather than the conventional combination of zirconium and columbium strengthening elements.

FIG. 1 helps distinguish our discovery from that of U.S. Pat. No. 3,666,543. With reference to FIG. 1, a sum aluminum plus tin greater than about 11% is necessary to observe the beneficial effects of hafnium and tantalum which are independent of silicon content. This is substantially above that specified by Goosey.

It will be observed from the results listed in the Tables that the alloy of Example 10 which contains the combination of hafnium and tantalum as a supplement to the conventional zirconium and columbium additions does not display the large strength improvement of the alloys which contain the combination of tantalum and/or hafnium. This result may occur because the combined level of columbium and tantalum may exceed the solubility limit of the alpha titanium and cause the onset of precipitation of the weaker cubic beta titanium phase. The composition of the alloy of Example 10 sets an approximate upper boundary on the amount of columbium which can successfully and beneficially be included in an alloy.

EXAMPLES 11, 12 AND 13

Three additional alloy compositions were prepared to have the ingredient content listed in Table 4.

TABLE 4

Compositions of experimental alloys in atomic % produced by rapid solidification inert gas atomization

| Alloy | Ti | Al | Zr | Hf | Sn | Cb | Ta | Mo | Other | |
|---|---|---|---|---|---|---|---|---|---|---|
| 11 | 84.7 | 11.9 | 1.2 | — | 1.1 | 0.5 | — | 0.1 | 0.5Er | |
| 12 | 81.9 | 13.6 | — | 1.4 | 1.3 | — | 0.8 | — | 0.4Y | 0.6Si |
| 13 | 81.9 | 12.3 | 1.7 | 0.7 | 1.4 | 0.6 | — | 0.1 | 0.8Er | 0.5Si |

Figure 2:
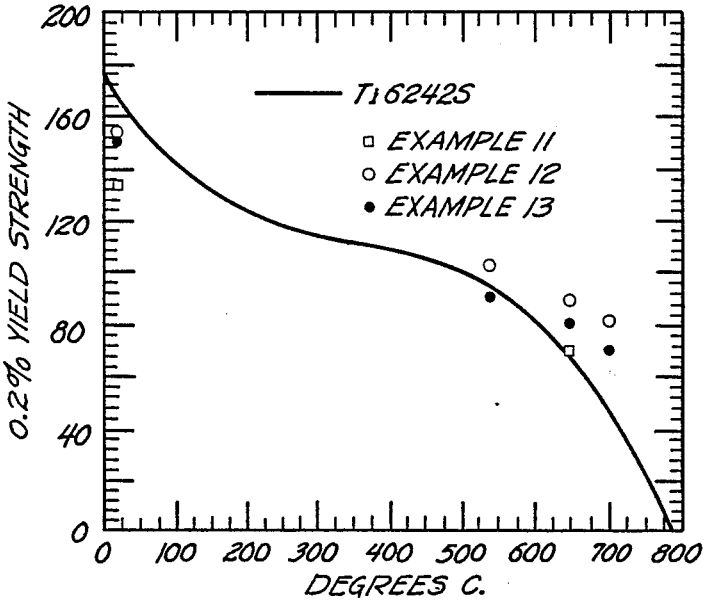
FIG. 2 is a graph of tensile strength against temperature in degrees Centigrade.

These alloy compositions were prepared and were atomized to a fine powder by inert gas atomization. The fine powder was consolidated and extruded and heat treated in the manner described with reference to the alloys of Examples 1–10 above following the HIPping, extrusion, and beta heat treatment of these samples. Following the consolidation and heat treatment, tensile specimens were prepared and tensile tests were conducted on the alloy samples of Examples 11, 12 and 13. Similar tests were also conducted on alloy Ti6242S following a beta heat treatment to bring the alloy to its best elevated temperature strength. The results of these tests are listed in Table 5 and are displayed in FIG. 2.

TABLE 5

Tensile strength of experimental alloy compositions produced from inert gas atomized powder and the conventionally processed Ti6242S

| Alloy | Temp | 0.2% Yield Strength | Ultimate Tensile Strength | % Elongation |
|---|---|---|---|---|
| Ti6242S | RT | 169.8 | 177.0 | 0.6 |
| Ti6242S | RT | 168.0 | 173.5 | 1.1 |
| Ti6242S | RT | 152.8 | 166.3 | 4.7 |
| Ti6242S | 200 C. | 128.7 | 139.0 | 1.4 |
| Ti6242S | 400 C. | 91.4 | 108.3 | 4.8 |
| Ti6242S | 400 C. | 114.2 | 132.5 | 2.9 |
| Ti6242S | 500 C. | 108.2 | 124.8 | 3.3 |
| Ti6242S | 540 C. | 89.3 | 101.3 | 12.9 |
| Ti6242S | 600 C. | 79.8 | 90.6 | 9.7 |
| Ti6242S | 600 C. | 79.4 | 90.2 | 9.7 |
| Ti6242S | 600 C. | 91.4 | 99.8 | 17.0 |
| Ti6242S | 625 C. | 89.6 | 98.0 | 18.9 |
| Ti6242S | 650 C. | 70.5 | 78.4 | 11.4 |
| Ti6242S | 650 C. | 69.8 | 78.5 | 21.2 |
| Ti6242S | 650 C. | 77.4 | 87.4 | 15.1 |
| Ti6242S | 675 C. | 49.7 | 58.2 | 22.4 |
| Ti6242S | 700 C. | 42.8 | 52.0 | 38.1 |
| 11 | 650 C. | 134.0 | 138.7 | 3.5 |
| 11 | 650 C. | 70.3 | 82.8 | 14.7 |
| 12 | RT | 154.0 | 162.7 | 4.5 |
| 12 | 540 C. | 102.1 | 113.6 | 1.8 |
| 12 | 650 C. | 89.3 | 103.6 | 14.9 |
| 12 | 700 C. | 80.9 | 90.9 | 17.2 |
| 13 | RT | 150.4 | 155.1 | 3.5 |
| 13 | 540 C. | 91.3 | 113.8 | 14.7 |
| 13 | 650 C. | 80.2 | 95.9 | 20.8 |
| 13 | 700 C. | 70.6 | 79.3 | 28.2 |

With reference now to Example 11, this alloy may be seen to be a conventionally strengthened alloy which contains the zirconium and columbium strengthening additives. In addition the alloy of Example 11 contains an erbium ingredient to form a rare earth compound dispersoid. From the results of the tensile tests listed in Table 5 it becomes evident that the alloy of Example 11 which, as noted above, is strengthened by columbium and zirconium is relatively low and is about equivalent to that of the Ti6242S alloy at 650° C.

With reference next to the alloy of Example 12, this alloy may be seen from the Tables to be a composition which employs the combination of tantalum and hafnium as the combined strengthening elements. In addition, the alloy of Example 12 contains yttrium to form a compound dispersoid. From the data in Table 5 it may also be seen that the alloy of Example 12 has a yield strength at 700° C. which is 89% higher than that of Ti6242S at this temperature.

With reference next to the alloy of Example 13, this composition relies on the use of hafnium as a strengthening element and on the use of erbium to form a rare earth dispersoid. From the data plotted in Table 5 it is evident that the alloy of Example 13 has a yield strength at 700° C. which is about 65% higher than that of Ti6242S alloy.

Tests of creep properties were conducted on the alloys of the Examples 11, 12 and 13 and were found to show unexpectedly good creep properties. In this connection the creep tests were performed on the alloys of the Examples 11, 12 and 13 as well as on the Ti6242S alloy and on the Ti5331S alloy at the 650° C. temperature and at a 20 ksi stress level. The results of the creep tests are listed in Table 6 and are displayed as a bar graph in FIG. 3.

TABLE 6

Creep resistance of experimental alloy compositions produced from inert gas atomized powder and the conventionally processed Ti6242S and Ti3351S

[Hours to % Creep]

| Alloy | 0.1% | 0.2% | 0.5% | 1.0% | 2.0% |
|---|---|---|---|---|---|
| Ti6242S | 0.5 | 1.4 | 4.7 | 8.0 | 11.7 |
| Ti5331S | 1.5 | 3.15 | 6.3 | 11.1 | 21.0 |
| Ti5331S | 2.5 | 4.7 | 8.2 | 13.2 | 22.2 |
| 11 | 0.3 | 1.0 | 5.5 | 17.7 | 47.7 |
| 12 | 2.7 | 13.5 | 82.7 | 259.5 | 736.8 |
| 13 | 0.8 | 3.1 | 18.4 | 64.2 | 181.9 |

Figure 3:
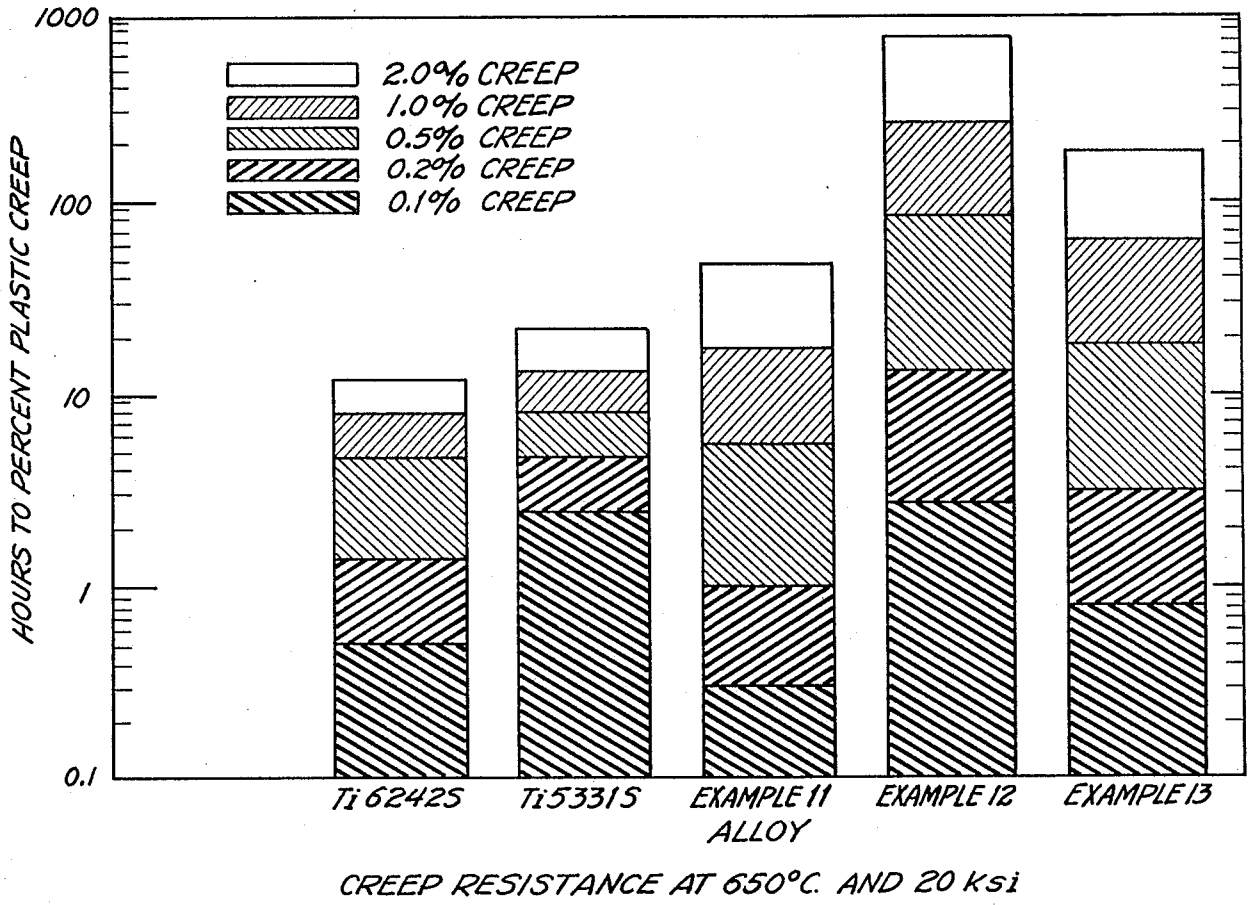
FIG. 3 is a graph of creep resistance at 650° C. and 20 ksi of several alloys shown on a comparative basis in terms of the hours to achieve a certain percentage plastic creep as identified in the FIG.

It is evident from the data of Table 6 and particularly from the way in which this data is displayed in FIG. 3 that the alloys of this invention exhibit uniquely and remarkably improved creep resistance over the conventional and prior art alloys. For the alloy of Example 13 the time to 0.5% creep is about twice that of the Ti5331S alloy and about four times that of the Ti6242S alloy. More remarkably still the alloy of Example 12 has a time to 0.5% creep which is ten times that of the alloy Ti5331S and greater than seventeen times that of the Ti6242S alloy. The doubling of the creep resistance of a conventional alloy is a remarkable achievement by itself and this, of course, is true for the alloy of Example 13. However, a tenfold or seventeenfold increase in this resistance is a most remarkable achievement.

EXAMPLES 14 AND 15

Two additional compositions were prepared. The preparation and testing of these compositions demonstrated that the beneficial results which have been demonstrated above from the addition of hafnium and tantalum to alpha titanium base alloy do not require the presence of yttrium or a rare earth metal compound as a dispersoid, nor do they require the presence of silicon, nor do they require rapid solidification.

The alloys of the two compositions for the Examples 14 and 15 are those as listed in Table 7.

TABLE 7

| Alloy | Ti | Al | Zr | Hf | Sn | Cb | Ta | Mo | Other |
|---|---|---|---|---|---|---|---|---|---|
| | Compositions of experimental alloys, atomic % produced by arc melting and press forging | | | | | | | | |
| 14 | 84.7 | 12.2 | 1.3 | — | 1.2 | 0.5 | — | 0.1 | |
| 15 | 82.7 | 13.6 | — | 1.5 | 1.2 | — | 1.0 | 0.1 | |

The alloy of Example 14 is an alpha titanium alloy strengthened by the conventional additions of zirconium and columbium. The alloy of Example 15 is an alpha titanium alloy of this invention which is strengthened by hafnium and tantalum.

The alloys were prepared by the same steps and the same procedures. They were first melted by a conventional arc melting of a button. The button was then press forged. This forging was followed by a beta solution heat treatment and by a further 600° C. age treatment of the forging. Stress rupture tests were performed on the alloys at 650° C. at a stress of 30 ksi. The results of these tests are listed in Table 8.

TABLE 8

| Alloy | atomic % (Al + Sn) | Time to Rupture |
|---|---|---|
| | Stress Rupture Resistance of Ti Alloys at 650° C. and 30 ksi | |
| 14 | 13.4 | 8.5 |
| 15 | 14.8 | 48.5 |

The alloy strengthened with the combination of hafnium and tantalum may be seen from Table 8 to exhibit over five times the stress rupture life of the alloy which is strengthened with the conventional combination of zirconium and columbium. It will also be seen from Table 8 taken with Table 7 that the alloy of Example 15 has a higher aluminum plus tin content than that of the alloy of Example 14. The higher aluminum plus tin content of alloy 15 is 14.8% and that of alloy 14 is respectively 13.4%.

From the data plotted in FIG. 1 it is reasonable to conclude that the presence of higher concentrations of aluminum and tin in an alloy contribute in part to improved rupture resistance of that alloy. On the basis of this conclusion the rupture resistance of alloy 15 might be expected to be somewhat higher than the rupture resistance of alloy 14 because the aluminum plus tin concentration of alloy 15 is greater than that of alloy 14.

However, this difference in aluminum plus tin concentration can be calibrated quantitatively to an approximate degree using the slope of the creep life curve for alloys of Examples 6–8 of FIG. 1. Using this calibration, if the alloy of Example 15 had an aluminum plus tin level of 13.4% (rather than the actual 14.8%) its rupture life would be about 75% of the rupture life of an alloy with the higher aluminum plus tin level (of 14.8%). The lower aluminum plus tin concentration of 13.4% would correspond, using the calibration of upper curve of FIG. 1 to a rupture life of about 36 hours (about 3/4 of the 48.5 hours actually measured for alloy 15).

Accordingly the rupture life of the alloy of Example 15, even if calibrated for its higher aluminum plus tin concentration, would still be four fold greater than the 8.5 hour rupture life measured for alloy 14.

This, accordingly, demonstrates conclusively that the major cause of the stress rupture life improvement of the alloy of Example 15 is the presence of the combination of the hafnium and tantalum in the alloy of Example 15 as compared to that of alloy 14.

Figure 4:
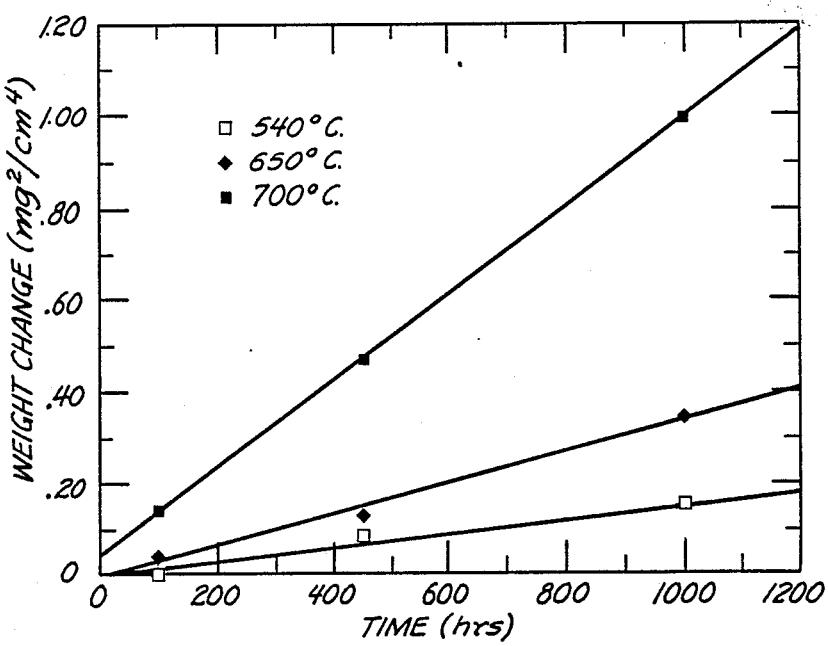
FIG. 4 is a graph of the oxidation of one of the alloys of the present invention in which the square of the weight change in milligrams$^2$ per centimeter$^4$ is plotted against time in hours.
Figure 5:
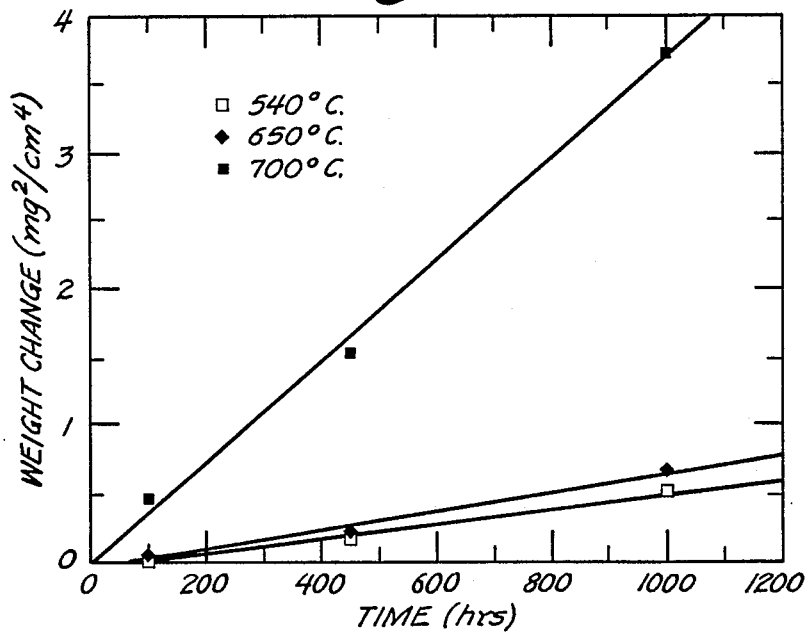
FIG. 5 is a graph in which oxidation of an alloy of the present invention is graphed and in which the square of the weight change in milligrams$^2$ per centimeter$^4$ is plotted against time.

Another feature of the compositions of the subject invention is that they display a unique and remarkable resistance to oxidation. In this connection, oxidation resistance of the alloys of Examples 12 and 13 were measured at 540° C., 650° C. and 700° C. The results of these tests are displayed in the FIGS. 4 and 5. In these FIGS. the square of the weight change per unit area is plotted against hours of exposure of the alloy at the designated temperatures. It was discovered from this study and from the data developed from the study, that the rate of weight change at a given temperature obeys a relationship as follows:

$$(\text{weight change/unit area})^2 = k(\text{hrs. exposure})$$

In this expression k is called the parabolic rate constant and is a function of temperature.

Figure 6:
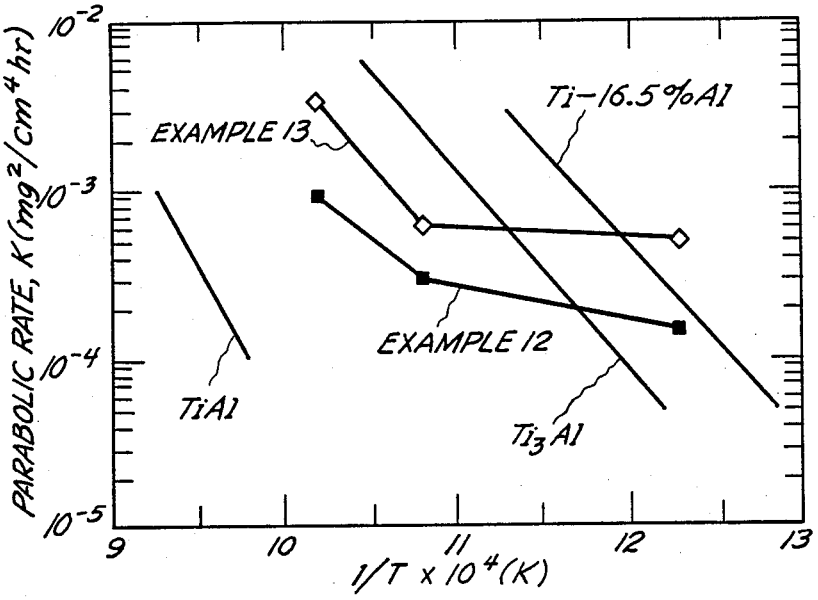
FIG. 6 is a graph in which the parabolic rate, k, in (milligrams$^2$ per centimeter$^4$ squared per hour) is plotted against the reciprocal temperature in inverse (degrees kelvin).

The parabolic rate constants are plotted against inverse temperature in FIG. 6. As a basis for comparison, the rate constants for a number of other compositions is plotted in FIG. 6 as well. The compositions for which the rate constants are plotted are as follows: 50 at. % aluminum compound TiAl in gamma crystalline form. The 25 at. % aluminum compound $Ti_3Al$ in the alpha 2 crystalline form. The 16.5 at. % aluminum alpha titanium alloy.

It is known generally that oxidation resistance is expected to be a function of alloy aluminum content. Contrary to expectation, the result of the studies is that the alloys of Examples 12 and 13 have better oxidation resistance than the $Ti_3Al$ composition at 650° C. and at 700° C.

It is noted from Table 4 that alloy 12 has an aluminum concentration of 13.6 at. % and alloy 13 has an aluminum concentration of 12.3 at. %. From its formula, $Ti_3Al$ has an aluminum concentration of 25 at. %.

The aluminum content of $Ti_3Al$ on aluminum contents of alloys 12 and 13 on a weight basis was 6 wt.% and 8 wt.% respectively.

What was found to be surprising is that there was such a marked improvement in oxidation resistance of the rare earth containing compositions of this invention.

To better illustrate this unique property and feature of the composition of the present invention, comparison of oxidation resistance were made on the basis of weight percent content of aluminum and on the basis of the conventional and well established parabolic oxidation rate constants for several aluminum containing titanium alloys. The results are tabulated in Table 9.

TABLE 9

| Alloy | W/O Al | Constant at 700° C., K. |
|---|---|---|
| | 700° C. PARABOLIC OXIDATION RATE CONSTANTS OF TITANIUM ALLOY WITH VARIABLE ALUMINUM CONTENT | |
| TiAl | 34 w/o | $\sim 1.5 \times 10^{-5}$ (*) |
| $Ti_3Al$ | 14 w/o | $\sim 9.0 \times 10^{-3}$ (*) |
| Ti-10Al | 14 w/o | $\sim 1.4 \times 10^{-2}$ (*) |
| Ti-7Al-4Mo | 7 w/o | $\sim 1.3 \times 10^{-2}$ (+) |
| Ti-6Al-4V | 6 w/o | $\sim 1.9 \times 10^{-2}$ (+) |
| Ti-4Al-4Mn | 4 w/o | $\sim 3.9 \times 10^{-2}$ (+) |
| Example 12 | 8 w/o | $9.52 \times 10^{-4}$ |
| Example 13 | 6 w/o | $3.66 \times 10^{-3}$ |

(*) These data values are taken from a paper entitled "Oxidation of Titanium Aluminides" by A. I. Kahveci, G. Welsch and G. E. Wasielewski presented at and to be published in the Proceedings of the Sixth World Conference on Titanium, which conference was held at Cannes, France on June 6-9, 1988 by the Societe Francaise de Metallurgie.

(+) These data were calculated from a paper entitled "On the Scaling Behavior of Commercial Titanium Alloys" by Klaus Rudinger and Hans Weigand as published in Titanium Science and Technology, Proceedings of the Second International Conference on Titanium, May 2-5, 1972, Cambridge, MA., by R. I. Jaffee and H. M. Burte, eds., pp. 2555-2571, Plenum Press, NY, 1973.

Figure 7:
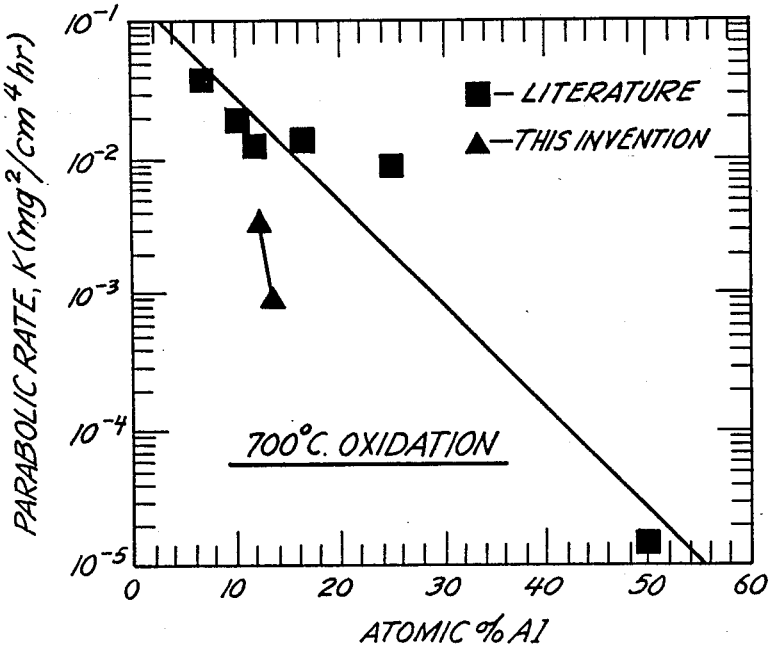

It is evident from the data listed in Table 9 that the alloys of the present invention, which have the rare earth additions, have oxidation resistance values which are 6 to 15 times better than alloys which contain the same aluminum content but which did not contain rare earth elements. The results are also plotted in FIG. 7 and this plot displays graphically the surprising differences in oxidation rate which have been discovered.

What is claimed is:

1. A titanium base alloy consisting essentially of the following ingredients in atom percent:

| Ingredient | Ingredient Concentration From | To |
|---|---|---|
| Titanium | balance | |
| Aluminum | 11 | 15 |
| Tin | 0 | 2 |
| Hafnium | 0.5 | 3 |
| Tantalum | 0 | 1.5 |
| Zirconium | 0 | 2 |
| Niobium | 0 | 1 |
| At least one metal selected from the group consisting of molybdenum, tungsten and rhenium | 0 | 1 |
| At least one metal selected from the group consisting of scandium, yttrium, and some rare earth metals and their mixtures | 0 | 1.3 |
| Silicon | 0.1 | 0.8. |

2. The alloy of claim 1 which has been rapidly solidified.

3. A titanium base alloy having the following ingredients in atom percent:

| Ingredient | Ingredient Concentration From | To |
|---|---|---|
| Titanium | balance | |

-continued

| Ingredient | Ingredient Concentration From | To |
|---|---|---|
| Aluminum | 9 | 11 |
| Tin | 1.1 | 2.1 |
| Hafnium | 0.2 | 1.2 |
| Tantalum | 0 | 0.5 |
| Zirconium | 1 | 2 |
| Niobium | 0 | 1 |
| Molybdenum | 0 | 0.5 |
| At least one metal selected from the group consisting of scandium, yttrium and rare earth metals and their mixtures | 0.1 | 1 |
| Silicon | 0 | 1. |

4. The alloy of claim 3 which has been rapidly solidified.

5. A titanium base alloy having the following ingredients in atom percent:

| Ingredient | Ingredient Concentration From | To |
|---|---|---|
| Titanium | balance | |
| Aluminum | 13 | 15 |
| Tin | 0.5 | 1.8 |
| Hafnium | 1 | 2 |
| Tantalum | 0.5 | 1.5 |
| Zirconium | 0 | 0.5 |
| Niobium | 0 | 0.5 |
| At least one metal selected from the group consisting of molybdenum, tungsten and rhenium | 0 | 0.5 |
| At least one metal selected from the group consisting of scandium, yttrium and rare earth metals and their mixtures | 0.1 | 1 |
| Silicon | 0 | 1. |

6. The alloy of claim 5 which has been rapidly solidified.

* * * * *